US012599810B2

(12) United States Patent
Yang

(10) Patent No.: US 12,599,810 B2
(45) Date of Patent: Apr. 14, 2026

(54) TREADMILL, TREADMILL SYSTEM AND TREADMILL ASSEMBLY METHOD

(71) Applicant: REXON INDUSTRIAL CORP., LTD., Taichung (TW)

(72) Inventor: Ssu-Shun Yang, Taichung (TW)

(73) Assignee: REXON INDUSTRIAL CORP., LTD., Tali (TW)

( * ) Notice: Subject to any disclaimer, the term of this patent is extended or adjusted under 35 U.S.C. 154(b) by 108 days.

(21) Appl. No.: 18/803,223

(22) Filed: Aug. 13, 2024

(65) Prior Publication Data

US 2025/0345654 A1 Nov. 13, 2025

(30) Foreign Application Priority Data

May 7, 2024 (TW) ..... 113116885

(51) Int. Cl.
*A63B 22/02* (2006.01)
*A63B 22/00* (2006.01)

(52) U.S. Cl.
CPC ..... *A63B 22/02* (2013.01); *A63B 22/0046* (2013.01)

(58) Field of Classification Search
CPC . A63B 22/02; A63B 22/0046; A63B 22/0235; A63B 22/025; A63B 71/0054; A63B 21/4035; A63B 24/0087; A63B 2225/74; A63B 2230/208; A63B 2230/505; A63B 21/005; A63B 21/008; A63B 21/0085; A63B 22/0023; A63B 24/0059; A63B 2024/009; A63B 2071/0072; A63B 2071/0081; A63B 2071/0658; A63B 2071/0694; A63B 2220/53; A63B 2220/805; A63B 2225/09; A63B 2225/093; A63B 2225/685; A63B 2230/062; A63B 69/0057; A63B 2071/0625; A63B 2071/063; A63B 2071/0647; A63B 2071/0655; A63B 2220/13;

(Continued)

(56) References Cited

U.S. PATENT DOCUMENTS 5,368,532 A * 11/1994 Farnet ..... A63B 22/02 482/54
6,626,803 B1 * 9/2003 Oglesby ..... A63B 22/0242 482/54

(Continued)

FOREIGN PATENT DOCUMENTS

TW I765382 B 5/2022

*Primary Examiner* — Garrett K Atkinson
(74) *Attorney, Agent, or Firm* — HSML P.C.

(57) ABSTRACT

A treadmill includes a frame unit having two side seats, and a running unit disposed between the side seats. Each side seat includes a main plate, top and bottom plates respectively connected to top and bottom ends of the main plate, first and second slide grooves respectively formed in rear and front end portions of the main plate, and first and second through grooves formed in the bottom plate and respectively communicating with the first and second slide grooves. The running unit includes rear and front rotating shafts. Two opposite ends of the rear rotating shaft are moved upwardly and respectively into the first slide grooves through the first through grooves in the side seats. Two opposite ends of the front rotating shaft are moved upwardly and respectively into the second slide grooves through the second through grooves in the side seats.

8 Claims, 12 Drawing Sheets

(58) Field of Classification Search
CPC ..... A63B 2220/18; A63B 2220/30; A63B 2220/40; A63B 2220/803; A63B 2230/75; A63B 2071/0063; A63B 2220/56; A63B 2225/682; A63B 2230/06; A63B 22/0285; A63B 71/0622; A63B 2024/0093; A63B 2071/0691; A63B 2220/22; A63B 2225/50; A63B 2230/04; A63B 2230/207; A63B 2230/42; A63B 2230/50
See application file for complete search history.

(56) References Cited

U.S. PATENT DOCUMENTS 6,682,461 B2 * 1/2004 Wang ..... A63B 22/02 482/54
8,986,169 B2 * 3/2015 Bayerlein ..... A63B 21/0055 482/54
9,430,920 B2 * 8/2016 Munro ..... G08B 21/187
10,816,177 B1 * 10/2020 Bayerlein ..... A63B 71/0622
10,912,984 B2 * 2/2021 Liao ..... A63B 71/0054
11,369,835 B2 * 6/2022 Bayerlein ..... A63B 69/0057
2005/0039541 A1 * 2/2005 Kurono ..... A61B 5/1038 73/800
2006/0035757 A1 * 2/2006 Flick ..... A63B 22/0235 482/54
2008/0001772 A1 * 1/2008 Saito ..... B65G 39/16 340/679
2014/0066263 A1 * 3/2014 Huang ..... A63B 22/0242 482/54
2016/0213976 A1 * 7/2016 So ..... A63B 71/0622
2017/0136289 A1 * 5/2017 Frank ..... A63B 21/4035
2017/0333747 A1 * 11/2017 Athey ..... A63B 22/0228
2018/0140903 A1 * 5/2018 Poure ..... A63B 71/0622
2019/0217153 A1 * 7/2019 Bayerlein ..... A63B 71/0054
2020/0129837 A1 * 4/2020 Liao ..... A63B 24/0087
2020/0147447 A1 * 5/2020 Chiu ..... A63B 21/015
2021/0041092 A1 * 2/2021 Bayerlein ..... A63B 21/4035

* cited by examiner

TREADMILL, TREADMILL SYSTEM AND TREADMILL ASSEMBLY METHOD

CROSS-REFERENCE TO RELATED APPLICATION

This application claims priority to Taiwanese Invention Patent Application No. 113116885, filed on May 7, 2024, and incorporated by reference herein in its entirety.

FIELD

The disclosure relates to a sports equipment, and more particularly to a treadmill.

BACKGROUND

A treadmill with restraint device, as disclosed in Taiwanese Patent No. 1765382, is a slat-belt treadmill, and includes a frame having a front support portion and a rear support portion, and a running belt surrounding and supported by the front and rear support portions. When a user runs on the treadmill, a force generated by the user causes the running belt to move and drive the front and rear support portions to rotate accordingly.

However, the user may face some difficulties when assembling the above-mentioned treadmill, especially when mounting the running belt to the frame because the running belt has a certain weight, so that it requires the joint efforts of many people to mount the running belt to the frame. Moreover, since the running belt must be sleeved on the frame through the side thereof, one method is to stand the frame up on one side thereof, after which the running belt is sleeved on the other side of the frame from top to bottom; and another method is to slightly raise one side of the frame, after which the running belt is slidably sleeved on the frame from the one side thereof. No matter which method of assembly is used, it requires the joint efforts of many people to complete the assembly, thereby increasing the assembly costs of the above-mentioned treadmill.

SUMMARY

Therefore, an object of the present disclosure is to provide a treadmill that can alleviate at least one of the drawbacks of the prior art.

According to this disclosure, the treadmill includes a frame unit and a running unit. The frame unit includes a base frame and a top frame disposed on the base frame. The base frame includes two spaced-apart side seats extending in a front-rear direction, and a plurality of connecting rods interconnecting the side seats. Each side seat includes a main plate, top and bottom plates respectively connected to and extending outwardly from top and bottom ends of the main plate in a left-right direction, first and second slide grooves respectively formed in rear and front end portions of the main plate, and first and second through grooves formed in the bottom plate and respectively communicating with the first and second slide grooves. The first slide groove has a vertical groove section extending in an up-down direction, and a horizontal groove section extending rearwardly from a top end of the vertical groove section. A bottom end of the vertical groove section communicates with the first through groove. The second slide groove extends in the up-down direction, and has a bottom end communicating with the second through groove.

The running unit is disposed between the side seats, and includes a rear rotating shaft having two opposite ends respectively inserted into the first slide grooves in the side seats, a front rotating shaft having two opposite ends respectively inserted into the second slide grooves in the side seats, and a running belt surrounding the front and rear rotating shafts. The two opposite ends of the rear rotating shaft are inserted upwardly and respectively into the vertical groove sections of the first slide grooves through the first through grooves in the side seats, are respectively movable forward and rearward along the horizontal groove sections of the first slide grooves, and are positioned in the horizontal groove sections. The two opposite ends of the front rotating shaft are inserted upwardly and respectively into the second slide grooves through the second through grooves in the side seats, and are respectively positioned on top ends of the second slide grooves.

Another object of this disclosure is to provide a treadmill system that can alleviate at least one of the drawbacks of the prior art.

According to this disclosure, the treadmill system includes the above-mentioned treadmill, and at least two pairs of assembly modules for mounting the running unit to the base frame. Each assembly module includes a vertical threaded rod extending through the top plate of a corresponding side seat in the up-down direction, and a ring frame for insertion of the vertical threaded rod threadedly therethrough. The vertical threaded rod is rotated to allow the ring frame to move up and down along the vertical threaded rod. One pair of the at least two pairs of assembly modules is mounted on the rear rotating shaft, and the ring frames thereof are respectively sleeved on the two opposite ends of the rear rotating shaft. Another pair of the at least two pairs of assembly modules is mounted on the front rotating shaft, and the ring frames thereof are respectively sleeved on the two opposite ends of the front rotating shaft.

The at least two pairs of assembly modules are capable of driving the running unit to move relative to the base frame from an initial installation position to a final installed position. When the running unit is in the initial installation position, the two opposite ends of the rear rotating shaft are respectively located at the bottom ends of the vertical groove sections of the first slide grooves, and the two opposite ends of the front rotating shaft are respectively located at the bottom ends of the second slide grooves. When the running unit is in the final installed position, the two opposite ends of the rear rotating shaft are respectively located at the top ends of the vertical groove sections, and the two opposite ends of the front rotating shaft are respectively located at the top ends of the second slide grooves.

Still another object of this disclosure is to provide an assembly method of a treadmill of the above-mentioned treadmill system that can alleviate at least one of the drawbacks of the prior art.

According to this disclosure, each side seat further includes a tensioning module, the tensioning module includes a fixed member and a horizontal threaded rod, the at least two pairs of assembly modules includes three pairs of assembly modules, and the assembly method includes the steps of:

(A) placing the running unit on a ground surface, and then moving the base frame of the frame unit such that the side seats of the base frame are respectively located at two opposite sides of the running unit, the first through grooves in the side seats are respectively aligned with top sides of the two opposite ends of the rear rotating shaft, and the second through grooves in the side seats are respectively aligned with top sides of the two opposite ends of the front rotating shaft;

(B) lifting a rear end of the running unit so as to pass the two opposite ends of the rear rotating shaft upwardly and respectively through the first through grooves, followed by sleeving the ring frames of a first pair of the assembly modules respectively onto the two opposite ends of the rear rotating shaft, and inserting the vertical threaded rods of the first pair of the assembly modules threadedly and respectively into the ring frames in the up-down direction so as to respectively position the two opposite ends of the rear rotating shaft at bottom ends of the first slide grooves in the side seats;

(C) lifting a front end of the running unit so as to pass the two opposite ends of the front rotating shaft upwardly and respectively through the second through grooves, followed by sleeving the ring frames of a second pair of the assembly modules respectively onto the two opposite ends of the front rotating shaft, and inserting the vertical threaded rods of the second pair of the assembly modules threadedly and respectively into the ring frames of the second pair of the assembly modules in the up-down direction so as to respectively position the two opposite ends of the front rotating shaft at bottom ends of the second slide grooves in the side seats;

(D) rotating the vertical threaded rods of the first pair of the assembly modules so as to drive the ring frames of the first pair of the assembly modules together with the two opposite ends of the rear rotating shaft to move upwardly and respectively along the vertical groove sections of the first slide grooves to top ends of the first slide grooves, and rotating the vertical threaded rods of the second pair of the assembly modules so as to drive the ring frames of the second pair of the assembly modules together with the two opposite ends of the front rotating shaft to move upwardly and respectively along the second slide grooves to top ends of the second slide grooves;

(E) inserting the horizontal threaded rods of the tensioning modules of the side seats threadedly and respectively into the two opposite ends of the rear rotating shaft in the front-rear direction, and removing the first pair of the assembly modules assembled to the two opposite ends of the rear rotating shaft, after which the horizontal threaded rods are rotated to move the two opposite ends of the rear rotating shaft rearwardly and respectively to rear ends of the horizontal groove sections of the first slide grooves; and (F) mounting the top frame of the frame unit to a front end of the base frame.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 6:
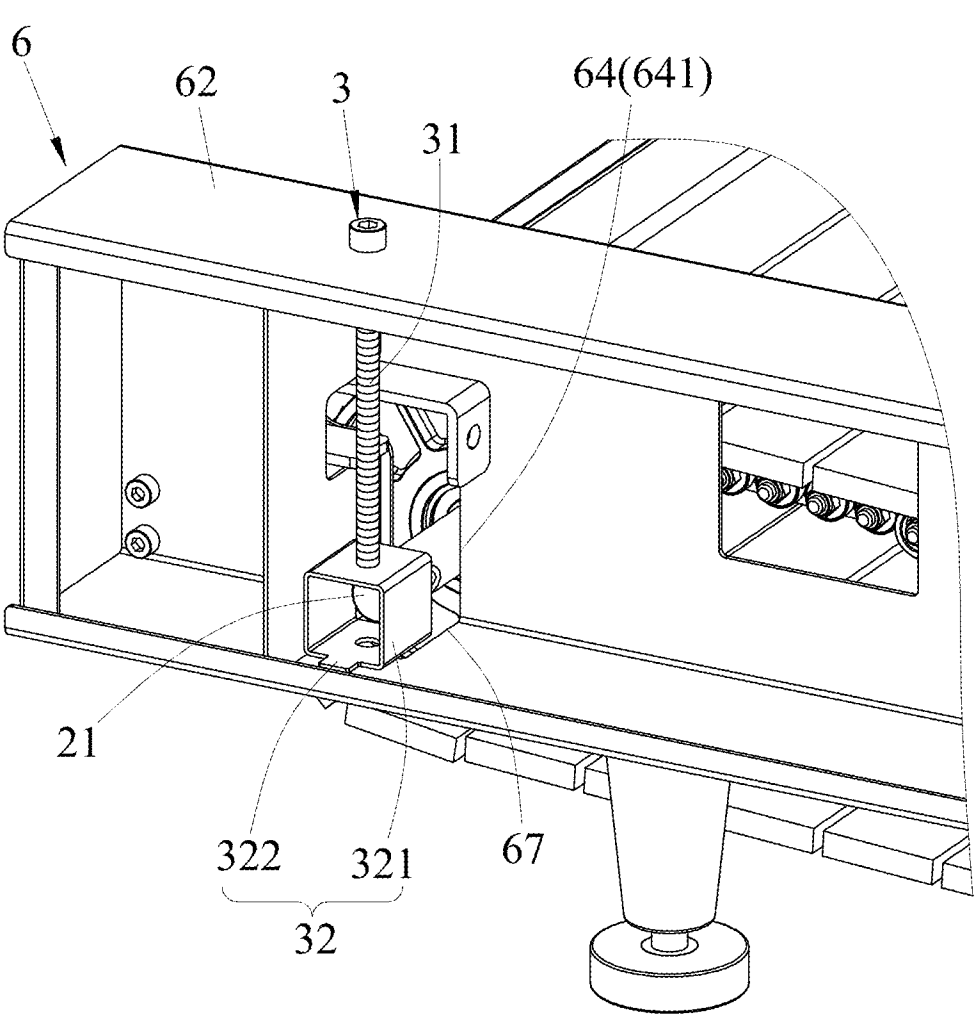
FIG. 6 is an enlarged perspective view of a portion of FIG. 5.

Referring to FIGS. 1 to 4, a treadmill system according to an embodiment of the present disclosure includes a treadmill, and four pairs of assembly modules 3 (see FIG. 6). The treadmill includes a frame unit 1 and a running unit 2. The frame unit 1 includes a base frame 4, and a top frame 5 disposed on a front end of the base frame 4.

The base frame 4 includes two spaced-apart side seats 6 extending in a front-rear direction (X), and a plurality of connecting rods 7 interconnecting the side seats 6 in a left-right direction (Y). Each side seat 6 includes a main plate 61, a top plate 62 and a bottom plate 63 respectively connected to and extending outwardly from top and bottom ends of the main plate 61 in the left-right direction (Y), a first slide groove 64 formed in a rear end portion of the main plate 61, a second slide groove 65 formed in a front end portion of the main plate 61, two third slide grooves 66 that are formed in the main plate 61, that are spaced apart from each other in the front-rear direction (X), and that are located between the first and second slide grooves 64, 65, a first through groove 67 formed in the bottom plate 63 and communicating with the first slide groove 64, a second through groove 68 formed in the bottom plate 63 and communicating with the second slide groove 65, and a tensioning module 60 disposed on the rear end portion of the main plate 61 and adjacent to the first slide groove 64. Each side seat 6 further includes a plurality of partition plates 600 each of which is connected to the main plate 61 and the top and bottom plates 62, 63. The front-rear direction (X), the left-right direction (Y) and the up-down direction (Z) are substantially perpendicular to each other.

The first slide groove 64 has a vertical groove section 641 extending in the up-down direction (Z), and a horizontal groove section 642 extending rearwardly from a top end of the vertical groove section 641. A bottom end of the vertical groove section 641 communicates with the first through groove 67. The second slide groove 65 extends in the up-down direction (Z), and has a bottom end communicating with the second through groove 68. Each third slide groove 66 extends in the up-down direction (Z).

The tensioning module 60 includes a fixed member 601 fixed to the main plate 61 and extending through an indentation of the partition plate 600 that is immediately adjacent to the first slide groove 64, and a horizontal threaded rod 602 movably inserted through the fixed member 601 in the front-rear direction (X).

Figure 1:
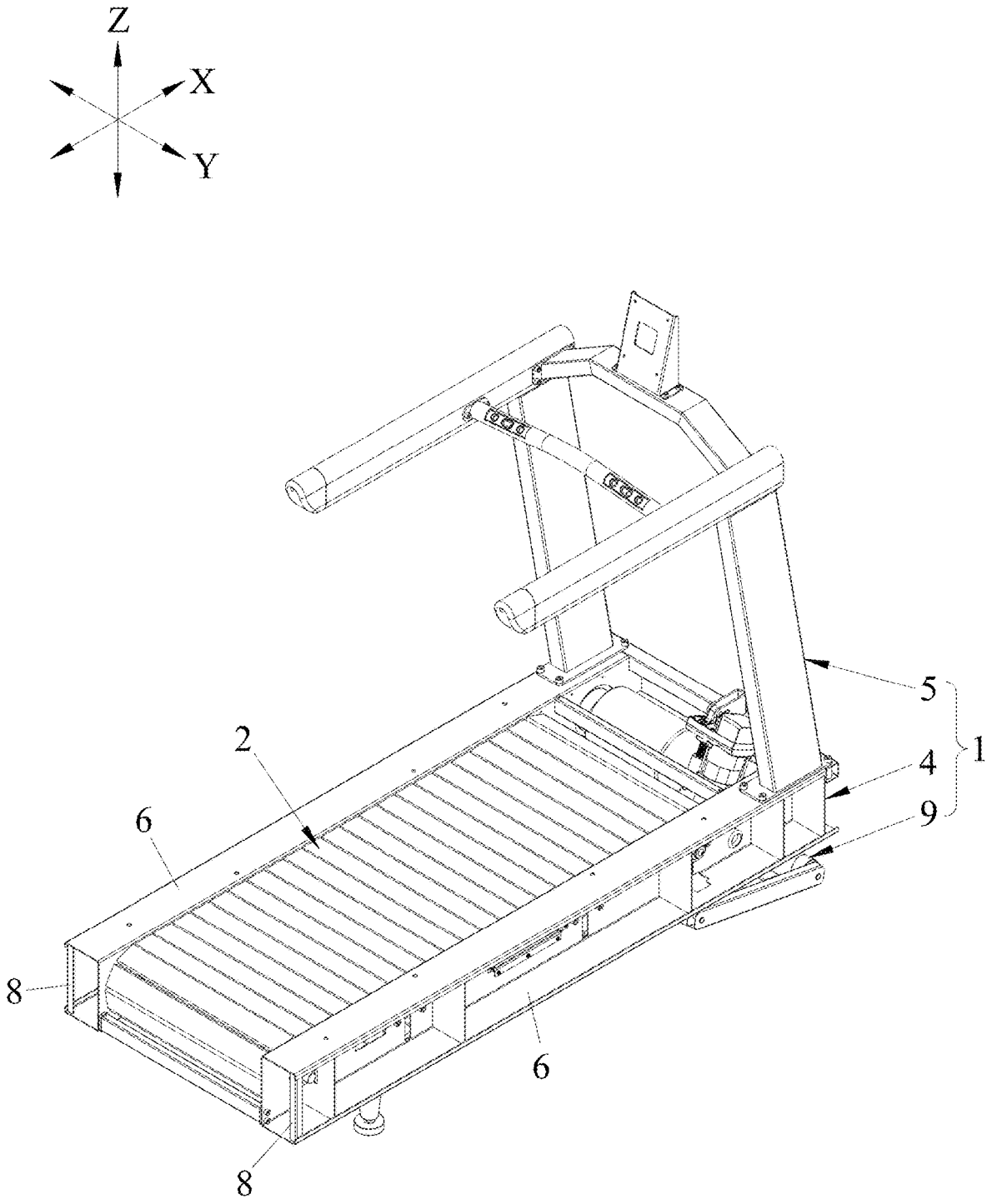
FIG. 1 is a perspective view of a treadmill of a treadmill system according to an embodiment of the present disclosure.
Figure 2:
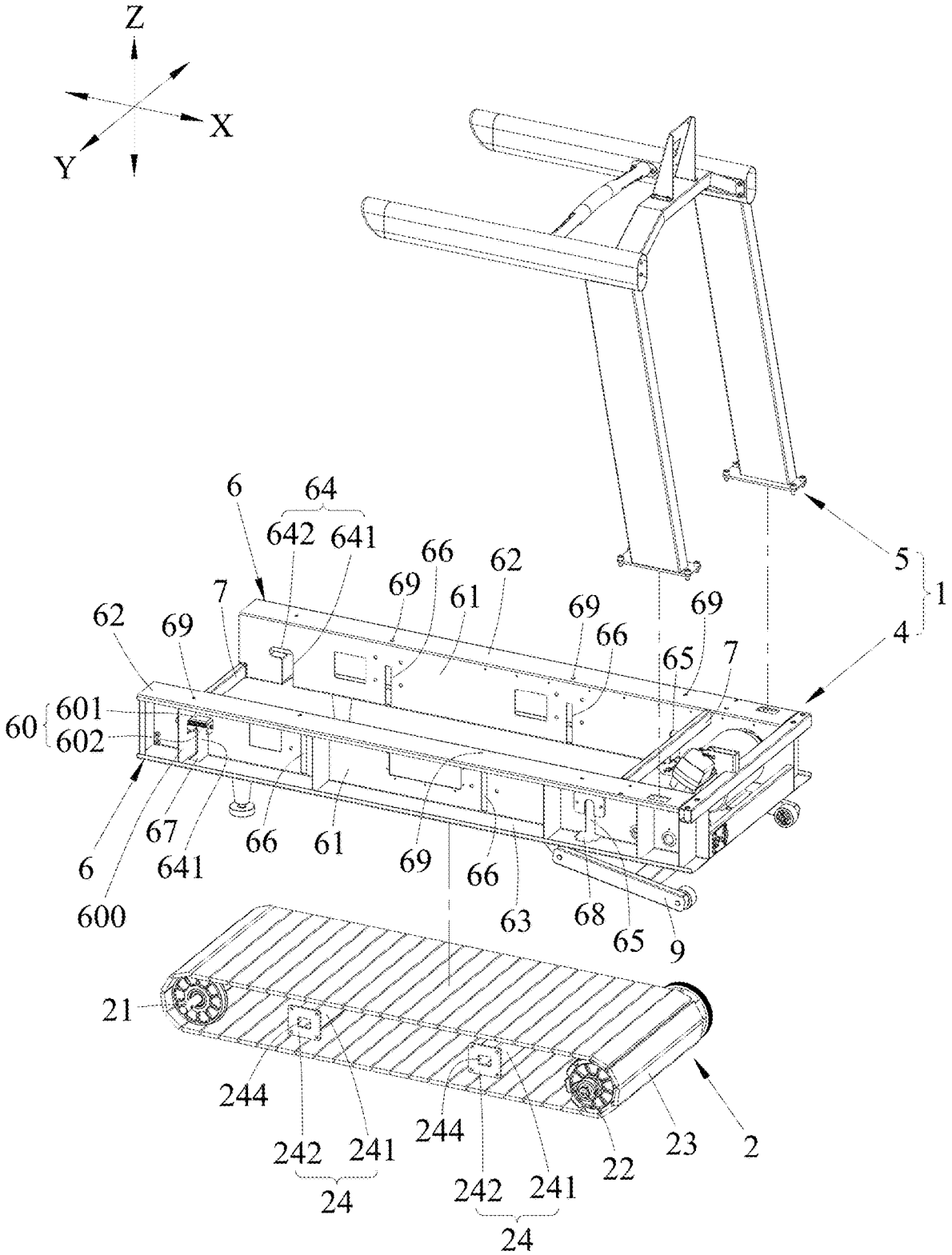
FIG. 2 is an exploded perspective view of the treadmill of the embodiment.

With reference to FIGS. 1 and 2, the running unit 2 is disposed between the side seats 6, and includes a rear rotating shaft 21 having left and right ends respectively inserted into the first slide grooves 64 in the side seats 6, a front rotating shaft 22 having left and right ends respectively inserted into the second slide grooves 65 in the side seats 6, two supporting rods 24 connected to and disposed between the side seats 6 and located between the front and rear rotating shafts 22, 21, and a running belt 23 surrounding the front and rear rotating shafts 22, 21 and the supporting rods 24.

Figure 11:
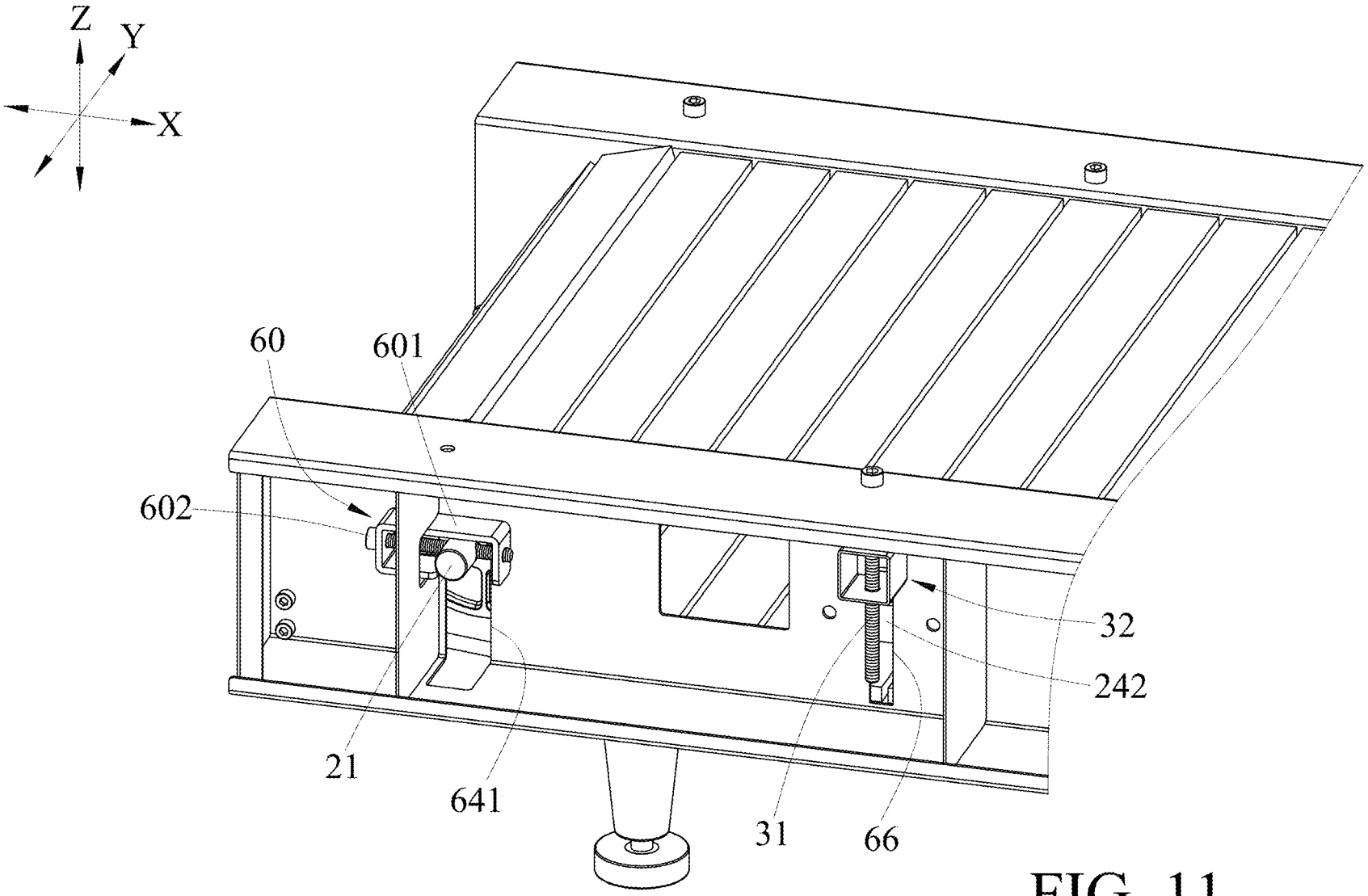
FIG. 11 is an enlarged perspective view of a portion of FIG. 10, illustrating a horizontal threaded rod of a tensioning module extending through the rear rotating shaft.
Figure 12:
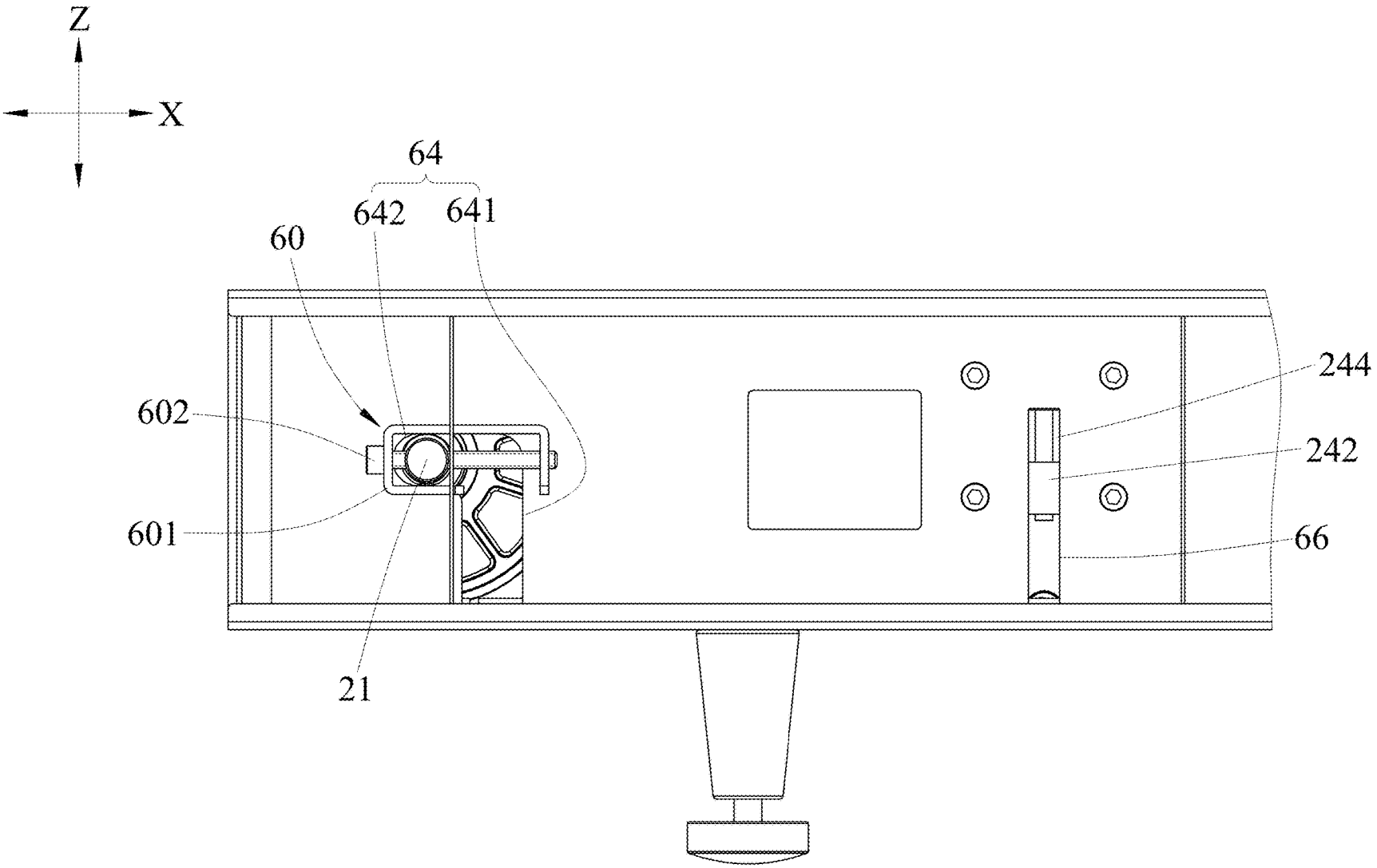
FIG. 12 is an enlarged side view of a portion of FIG. 10, illustrating how the horizontal threaded rod drives the rear rotating shaft to move rearwardly.

The horizontal threaded rods 602 of the tensioning modules 60 of the side seats 6 are configured to be respectively inserted into and threadedly engage threaded holes in the left and right ends of the rear rotating shaft 21 for driving the left and right ends of the rear rotating shaft 21 to move forward and rearward along the horizontal groove sections 642 of the first slide grooves 64, respectively (see FIGS. 11 and 12).

The left and right ends of the rear rotating shaft 21 can be inserted upwardly into the vertical groove sections 641 of the respective first slide grooves 64 through the first through grooves 67 in the side seats 6, are respectively movable forward and rearward along the horizontal threaded rods 602 of the tensioning modules 60 of the respective side seats 6, and can be positioned in the horizontal groove sections 642 of the respective first slide grooves 64. The left and right ends of the front rotating shaft 22 can be inserted upwardly and respectively into the second slide grooves 65 through the second through grooves 68 in the side seats 6, are movable up and down in the respective second slide grooves 65 and can be positioned on top ends of the respective second slide grooves 65. The supporting rods 24 are spaced apart in the front-rear direction (X), and are configured to support the running belt 23. Each supporting rod 24 corresponds in position to the third slide grooves 66 in the side seats 6 that are aligned in the left-right direction (Y), and includes a horizontal rod portion 241 extending in the left-right direction (Y), and two positioning plates 242 (only one is shown in FIG. 2) respectively disposed on left and right ends of the horizontal rod portion 241. Each positioning plate 242 abuts against an inner side of the main plate 61 of a respective one of the side seats 6, and has an inner peripheral surface 243 defining a positioning hole 244 that communicates with the third slide groove 66 in the respective side seat 6.

Figure 5:
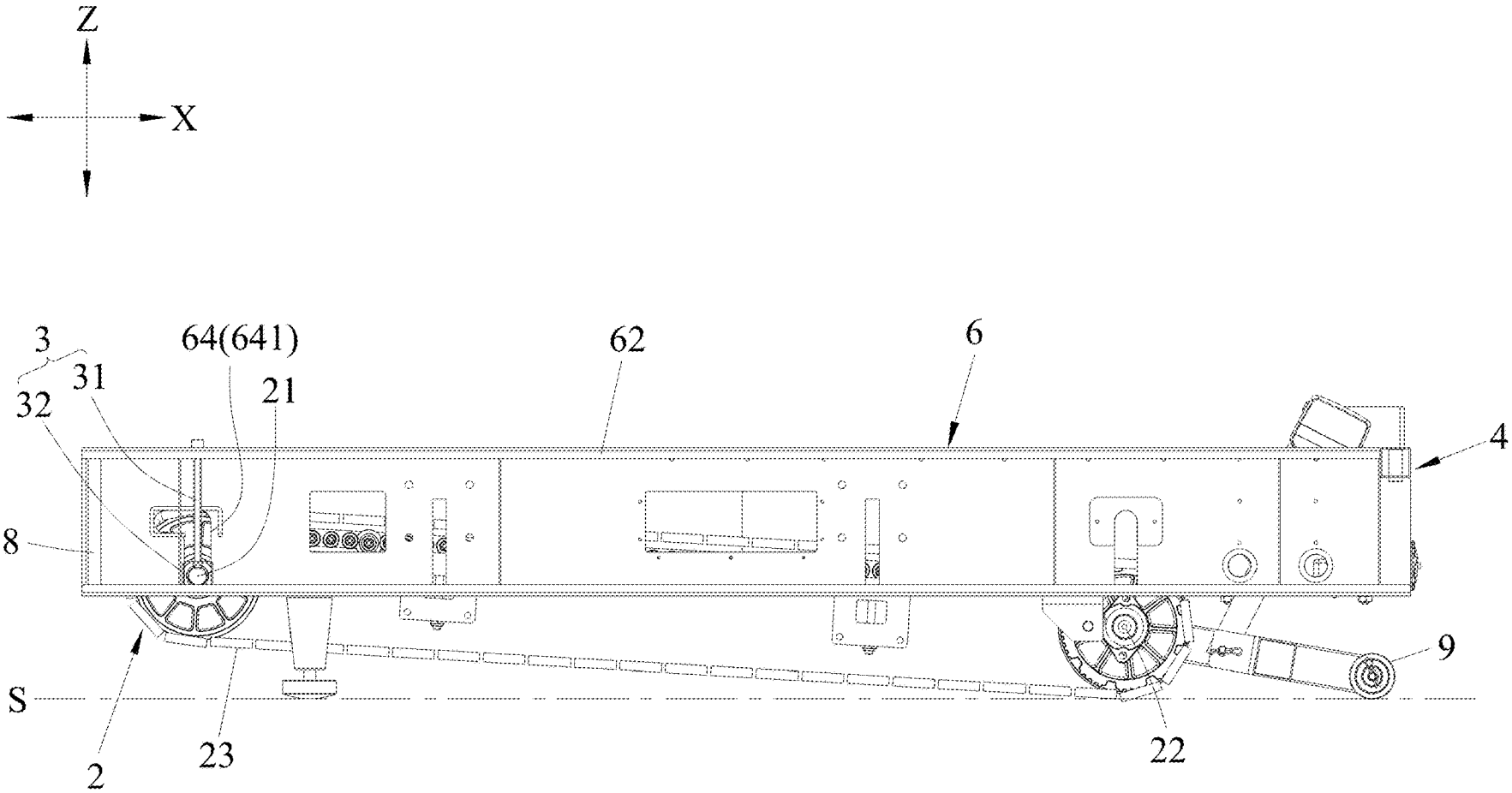
FIG. 5 is a view similar to FIG. 3, but with a rear end of the running unit being lifted, and a pair of assembly modules being mounted on the base frame.
Figure 7:
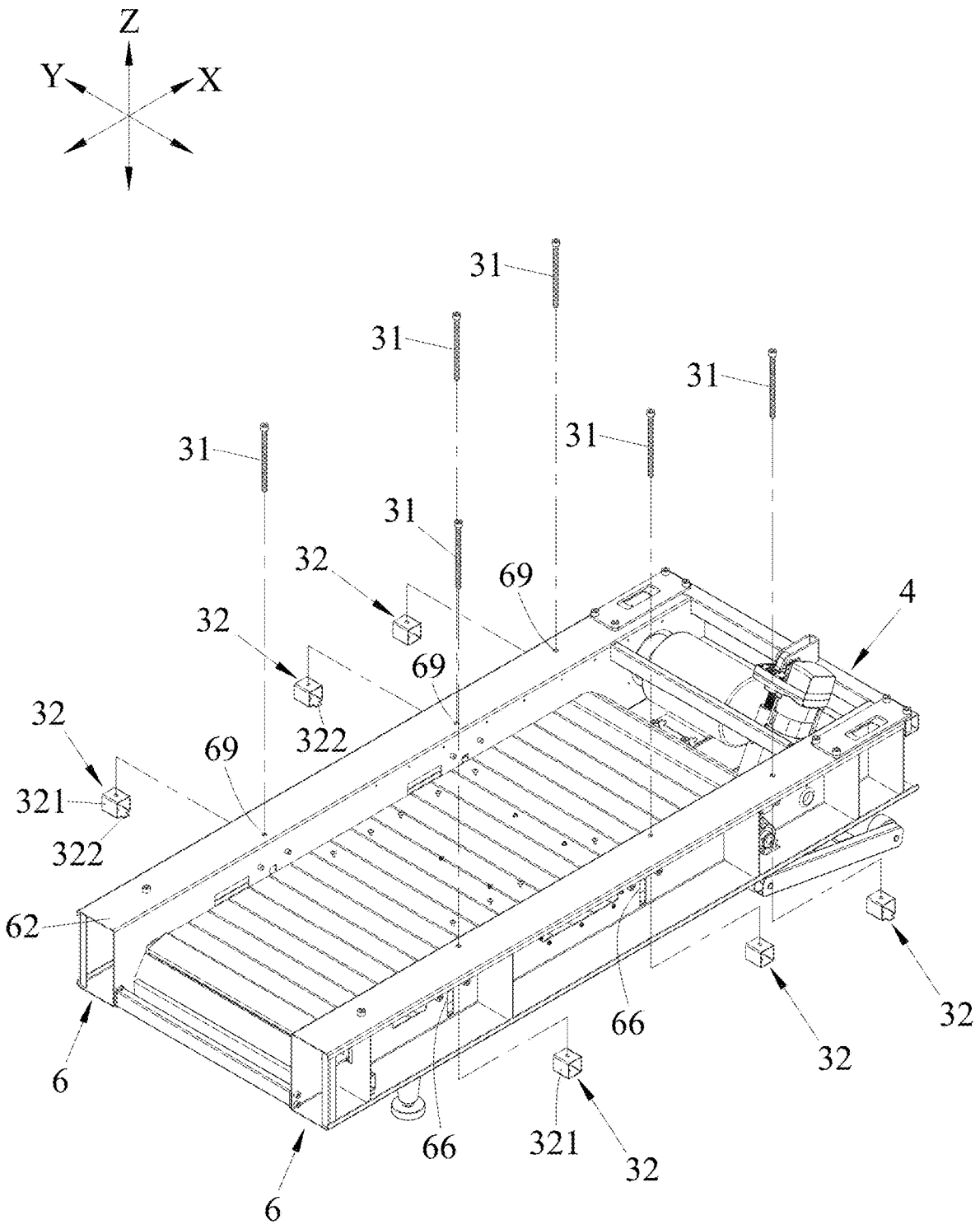
FIG. 7 illustrates how three pairs of assembly modules can be assembled by lifting a front end of the running unit.
Figure 10:
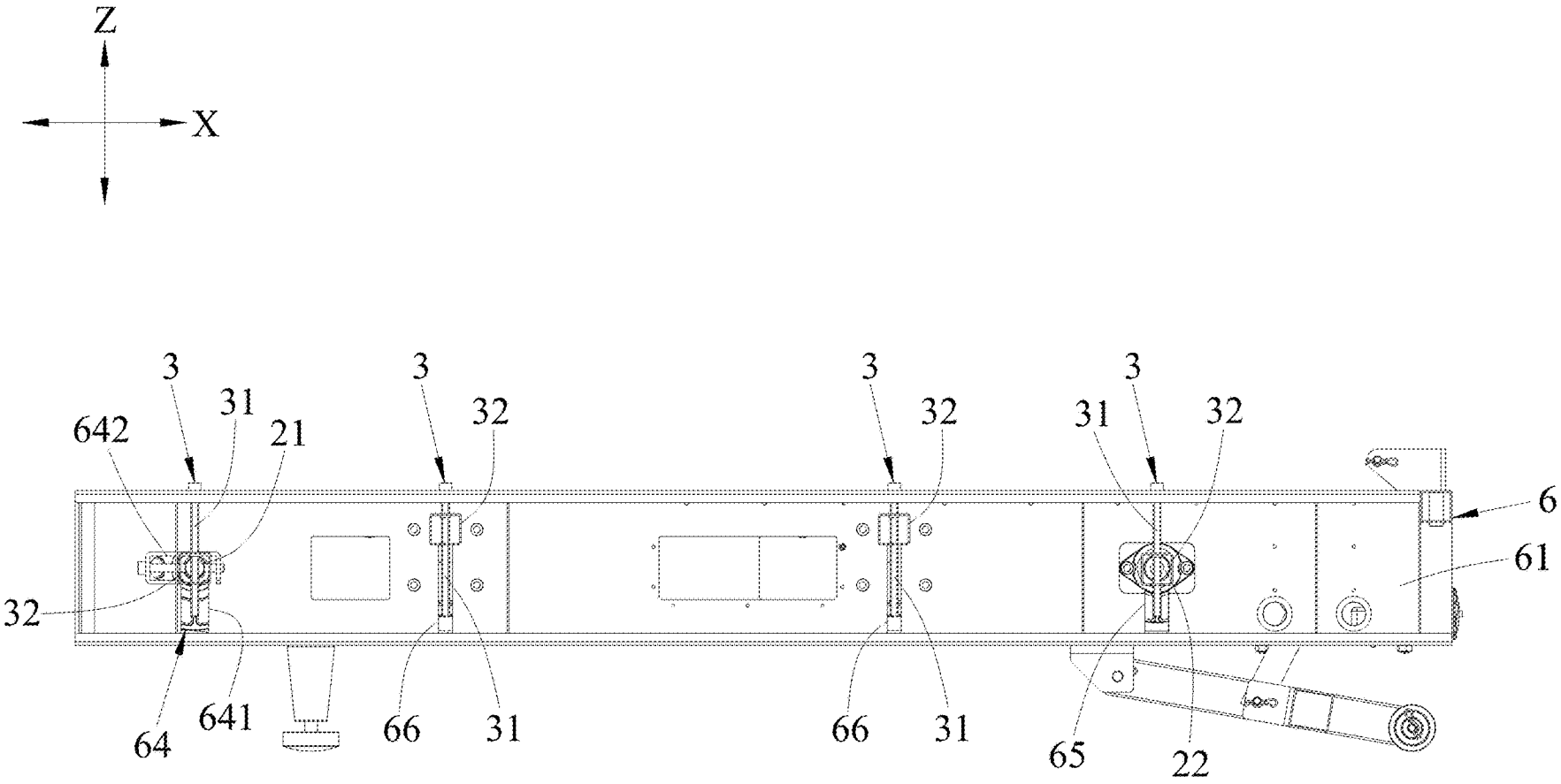
FIG. 10 illustrates the running unit in a final installed position relative to the frame unit.

Referring to FIGS. 5 to 7, the assembly modules 3 are used for mounting the running unit 2 to the base frame 4, and are capable of driving the running unit 2 to move relative to the base frame 4 from an initial installation position (see FIG. 8) to a final installed position (see FIG. 10). Each assembly module 3 includes a vertical threaded rod 31 extending through the top plate 62 of a corresponding one of the side seats 6 in the up-down direction (Z), and a ring frame 32 for insertion of the vertical threaded rod 31 threadedly therethrough. In this embodiment, the ring frame 32 is a square frame, and includes a surrounding wall 321, and an insert piece 322 protruding outwardly from the surrounding wall 321 in the left-right direction (Y). The ring frame 32 can move up and down along the vertical threaded rod 31 when the vertical threaded rod 31 is rotated.

Each side seat 6 further includes four through holes 69 formed in the top plate 62 and spaced apart from each other along a length thereof for extension of the vertical threaded rods 31 of the assembly modules 3 respectively therethrough.

Figure 8:
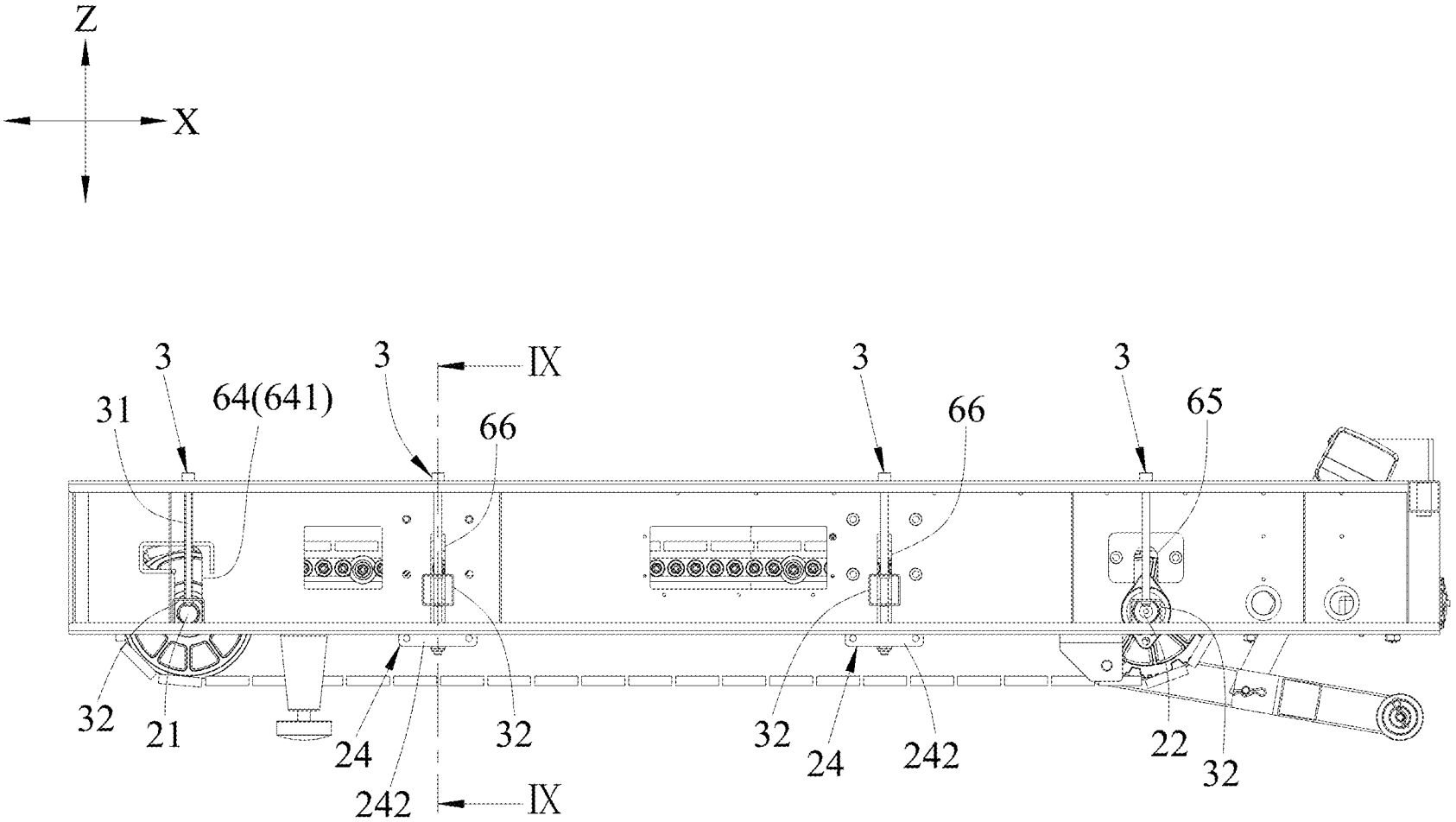
FIG. 8 illustrates the running unit in an initial installation position relative to the frame unit.

Referring to FIG. 8, in combination with FIGS. 6 and 7, a first pair of the assembly modules 3 is mounted on the rear rotating shaft 21, and the ring frames 32 thereof are respectively sleeved on the left and right ends of the rear rotating shaft 21; and a second pair of the assembly modules 3 is mounted on the front rotating shaft 22, and the ring frames 32 thereof are respectively sleeved on the left and right ends of the front rotating shaft 22.

Figure 9:
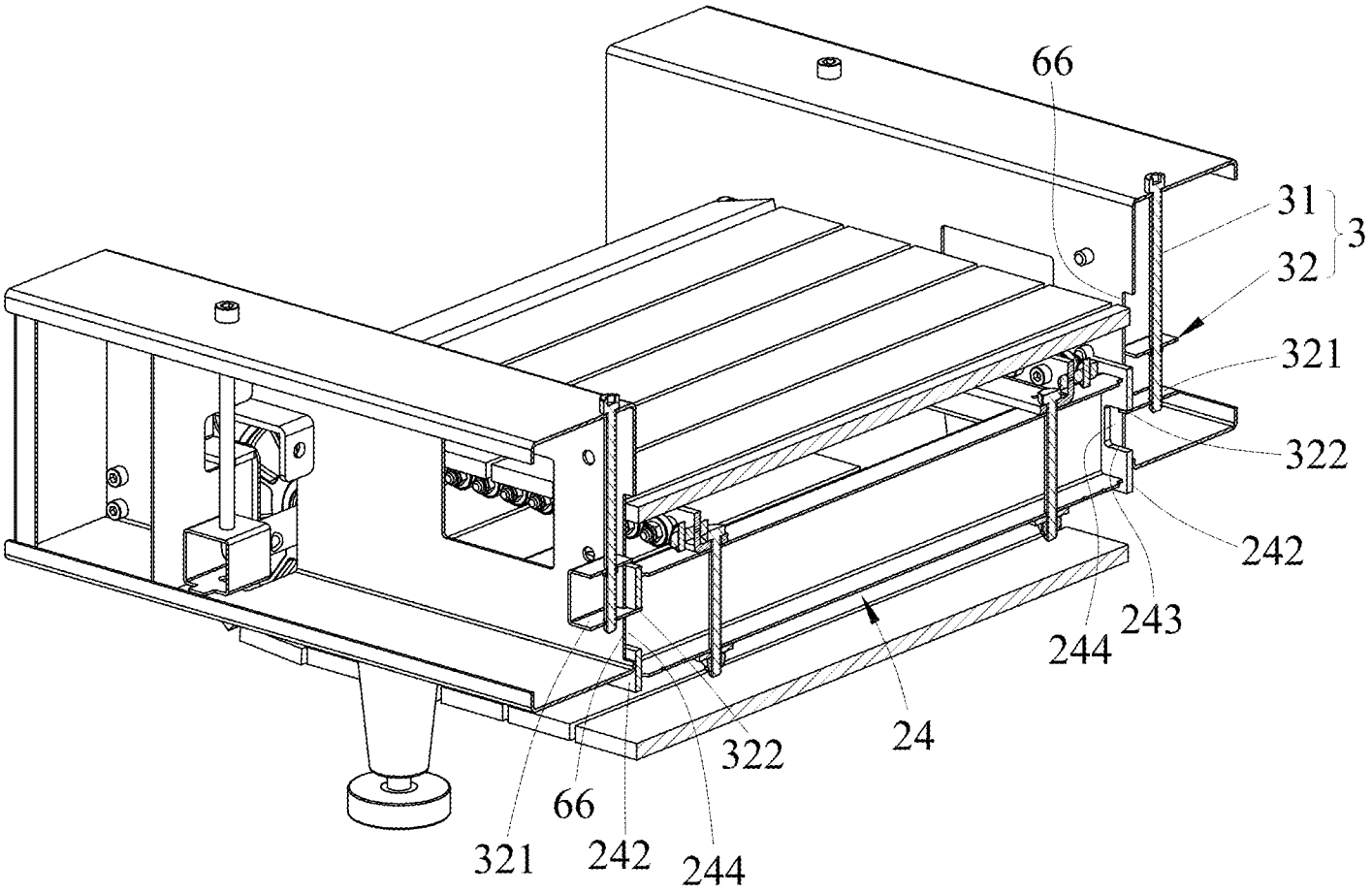
FIG. 9 is a perspective sectional view taken along line IX-IX of FIG. 8.

Referring to FIG. 9, in combination with FIG. 8, each of the remaining third and fourth pairs of the assembly modules 3 is mounted on a respective one of the supporting rods 24. The insert pieces 322 of the ring frames 32 of each of the third and fourth pairs of the assembly modules 3 are respectively inserted into the positioning holes 244 in the positioning plates 242 of the respective supporting rod 24, and respectively abut against top ends of the inner peripheral surfaces 243 of the positioning plates 242 of the respective supporting rod 24.

When the running unit 2 is in the initial installation position, the left and right ends of the rear rotating shaft 21 are respectively located at the bottom ends of the vertical groove sections 641 of the first slide grooves 64, the left and right ends of the front rotating shaft 22 are respectively located at the bottom ends of the second slide grooves 65, and the positioning holes 244 in the positioning plates 242 of each supporting rod 24 respectively correspond in position to bottom ends of the third slide grooves 66 in the side seats 6.

Referring to FIGS. 10 to 12, when the running unit 2 is in the final installed position, the left and right ends of the rear rotating shaft 21 are respectively located at the top ends of the vertical groove sections 641 of the first slide grooves 64, the left and right ends of the front rotating shaft 22 are respectively located at the top ends of the second slide grooves 65, and the positioning holes 244 in the positioning plates 242 of the supporting rods 24 respectively correspond in position to top ends of the third slide grooves 66 in the side seats 6.

By rotating the vertical threaded rods 31 of each pair of the assembly modules 3 to move the ring frames 32 thereof up and down along the vertical threaded rods 31, the ring frames 32 of the first pair of the assembly modules 3 mounted on the rear rotating shaft 21 can drive the left and right ends of the rear rotating shaft 21 to move from the bottom ends of the vertical groove sections 641 to the top ends thereof, the ring frames 32 of the second pair of the assembly modules 3 mounted on the front rotating shaft 22 can drive the left and right ends of the front rotating shaft 22 to move from the bottom ends of the second slide grooves 65 to the top ends thereof, and the ring frames 32 of each of the third and fourth pairs of the assembly modules 3 mounted on the respective supporting rod 24 can drive the left and right ends of the horizontal rod portion 241 of the respective supporting rod 24 to move from the bottom ends of the third slide grooves 66 to the top ends thereof. Through this, the running unit 2 can be moved from the initial installation position to the final installed position.

The assembly method of the treadmill of the treadmill system of this disclosure includes steps (A) to (F).

Figure 3:
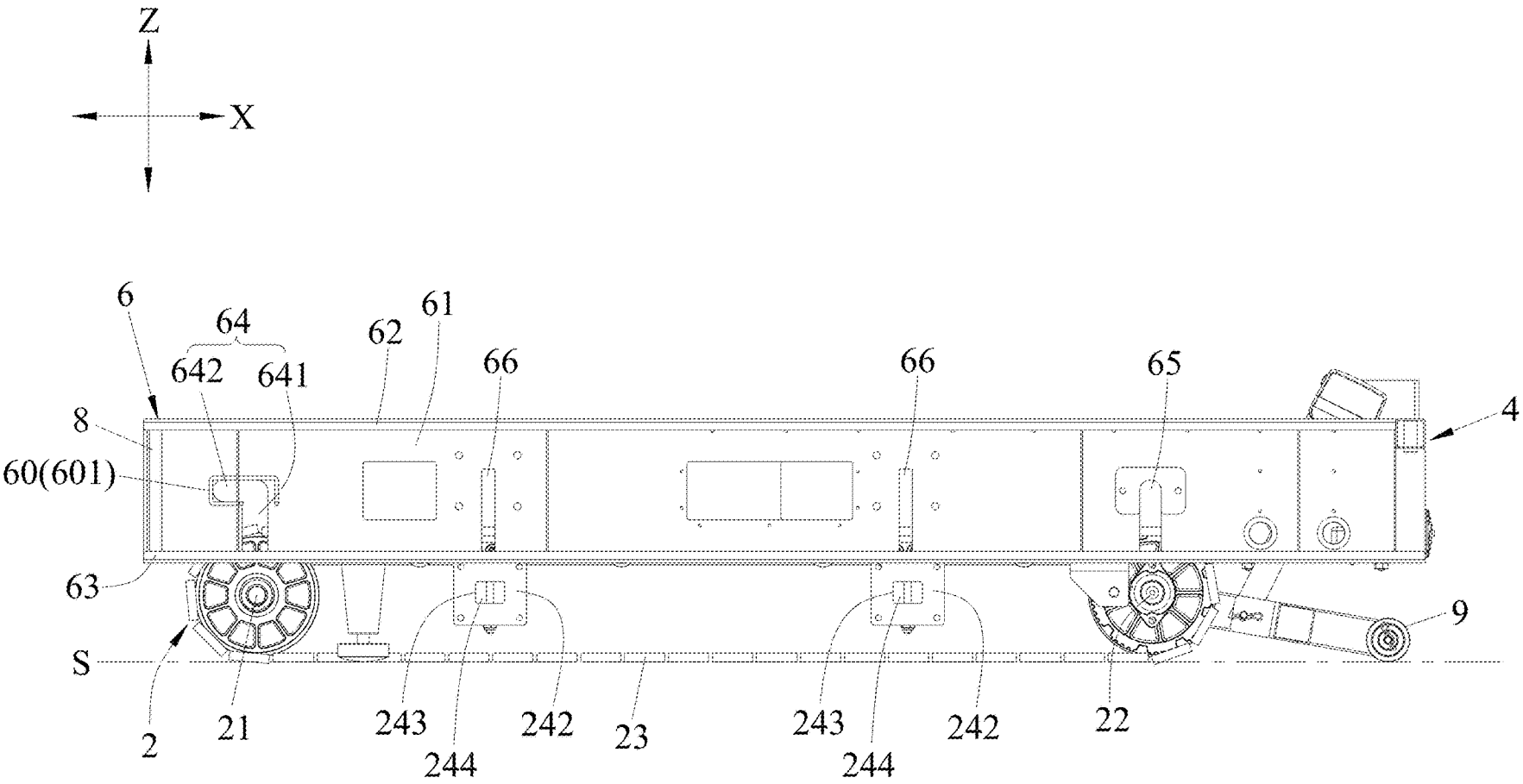
FIG. 3 is a schematic side view of the embodiment, illustrating how a base frame of a frame unit of the treadmill is moved to a running unit of the treadmill that is placed on a ground surface.
Figure 4:
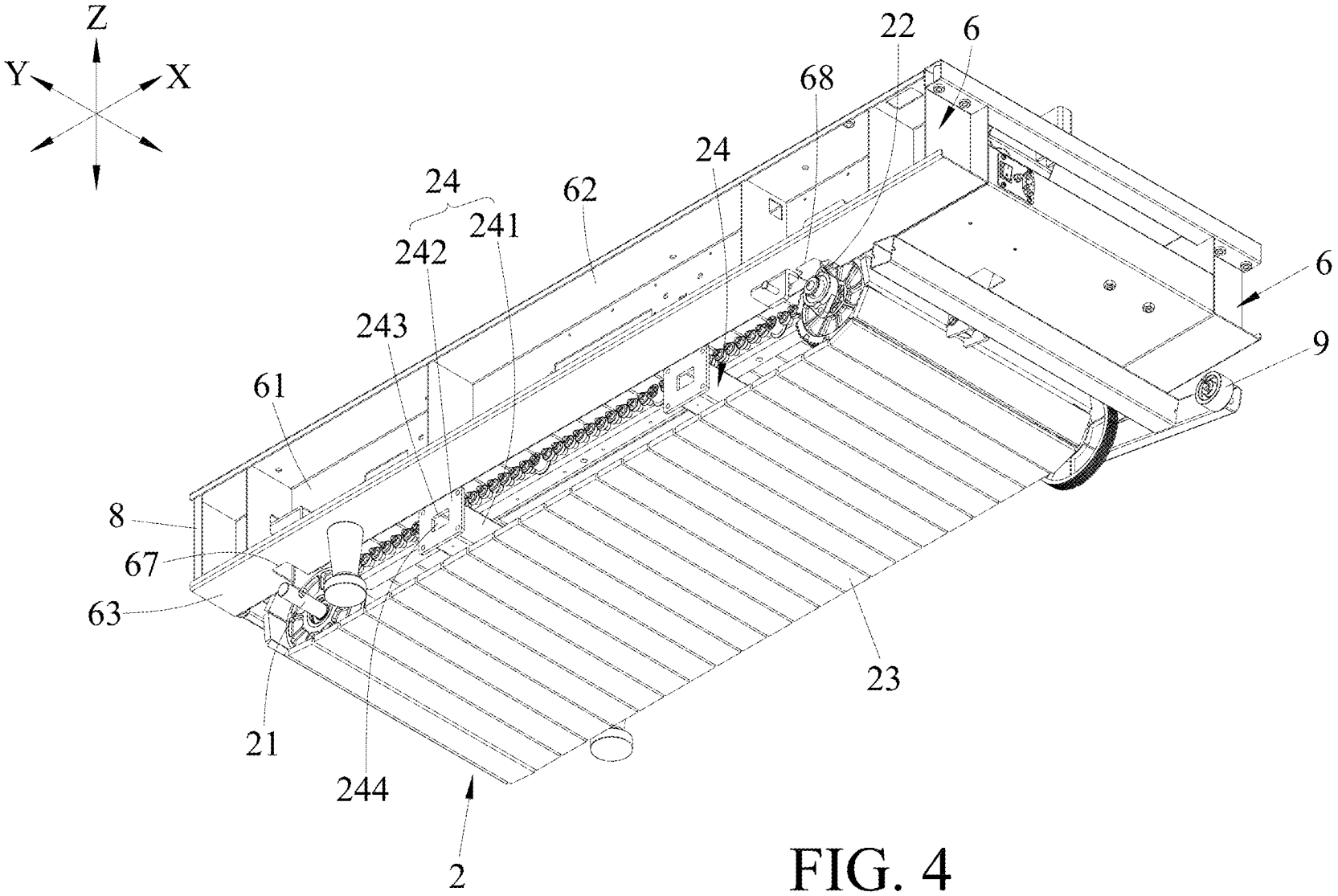
FIG. 4 is a bottom perspective view of FIG. 3, illustrating a rear rotating shaft and a front rotating shaft of the running unit respectively corresponding to two first through grooves and two second through grooves of the base frame.

In step (A), with reference to FIGS. 3 and 4, the running unit 2 is first placed on a ground surface(S), and then a user grips two handles 8 (see FIG. 1) on rear ends of the side seats 6, lifts the base frame 4, and moves the base frame 4 through a roller set 9 disposed on a front side thereof until the side seats 6 of the base frame 4 are respectively located at left and right sides of the running unit 2. Afterwards, the base frame 4 is lowered such that the first through grooves 67 are respectively aligned with the left and right ends of the rear rotating shaft 21, and the second through grooves 68 are respectively aligned with the left and right ends of the front rotating shaft 22. At this time, the positioning holes 244 in the positioning plates 242 of the supporting rods 24 respectively correspond in position to the bottom ends of the third slide grooves 66 in the side seats 6.

In step (B), with reference to FIGS. 5 and 6, a rear end of the running unit 2 is lifted so as to pass the left and right ends of the rear rotating shaft 21 upwardly and respectively through the first through grooves 67, followed by sleeving the ring frames 32 of the first pair of the assembly modules 3 respectively onto the left and right ends of the rear rotating shaft 21. Then, the vertical threaded rods 31 of the first pair of the assembly modules 3 are inserted respectively and downwardly through the top plates 62 of the side seats 6 to engage threadedly and respectively the ring frames 32 thereof so as to position the left and right ends of the rear rotating shaft 21 at the bottom ends of the vertical groove sections 641 of the first slide grooves 64.

In step (C), with reference to FIGS. 7 to 9, a front end of the running unit 2 is lifted so as to pass the left and right ends of the front rotating shaft 22 upwardly and respectively through the second through grooves 68 (see FIG. 4), followed by sleeving the ring frames 32 of the second pair of the assembly modules 3 respectively onto the left and right ends of the front rotating shaft 22. Then, the vertical threaded rods 31 of the second pair of the assembly modules 3 are inserted respectively and downwardly through the top plates 62 of the side seats 6 to engage threadedly and respectively the ring frames 32 thereof so as to position the left and right ends of the front rotating shaft 22 at the bottom ends of the second slide grooves 65 in the side seats 6. Afterwards, the insert pieces 322 of the ring frames 32 of each of the third and fourth pairs of the assembly modules 3 are respectively passed through the third slide grooves 66 in the side seats 6 and then inserted into the positioning holes 244 in the positioning plates 242 of the respective supporting rod 24 such that the insert pieces 322 of each of the third and fourth pairs of the assembly modules 3 respectively abut against the top ends of the inner peripheral surfaces 243 of the positioning plates 242 of the respective supporting rod 24 so as to position the respective supporting rod 24 at the bottom ends of the third slide grooves 66.

In step (D), with reference to FIG. 10, the vertical threaded rods 31 of all the assembly modules 3 are rotated, so as to drive the ring frames 32 of the first pair of the assembly modules 3 together with the left and right ends of the rear rotating shaft 21 to move upwardly and respectively along the vertical groove sections 641 of the first slide grooves 64 in the side seats 6 to the top ends of the first slide grooves 64, so as to drive the ring frames 32 of the second pair of the assembly modules 3 together with the left and right ends of the front rotating shaft 22 to move upwardly and respectively along the second slide grooves 65 in the side seats 6 to the top ends thereof, and so as to drive the insert pieces 322 of the ring frames 32 of each of the third and fourth assembly modules 3 together with the respective supporting rod 24 to move upwardly and respectively along the third slide grooves 66 in the side seats 6 that are aligned in the left-right direction (Y) to a position corresponding to the top ends of the third slide grooves 66. Subsequently, the left and right ends of the front rotating shaft 22 are rotatably positioned on the respective main plates 61 of the side seats 6, and the positioning plates 242 of the supporting rods 24 are fixed to the main plates 61 of the side seats 6, so that the front rotating shaft 22 and the supporting rods 24 are positioned between the side seats 6. At this time, the assembly modules 3 mounted on the front rotating shaft 22 and the supporting rods 24 can then be removed.

In step (E), with reference to FIGS. 10 to 12, the horizontal threaded rods 602 of the tensioning modules 60 of the side seats 6 are respectively inserted into the left and right ends of the rear rotating shaft 21 in the front-rear direction (X), and the first pair of the assembly modules 3 assembled to the left and right ends of the rear rotating shaft 21 are removed, after which the horizontal threaded rods 602 are rotated to move the left and right ends of the rear rotating shaft 21 rearwardly and respectively to the rear ends of the horizontal groove sections 642 of the first slide grooves 64.

In step (F), the top frame 5 is mounted to a front end of the base frame 4.

Through the description of the above steps, the treadmill of this disclosure can be assembled using little manpower, especially under the circumstance where there is only one person in sight, and he/she can gradually complete the assembly of the treadmill according to the steps of the above-described assembly method.

It should be noted that the running unit 2 may have only one supporting rod 24, each side seat 6 may have only one third slide groove 66, and only one pair of the assembly modules 3 may correspond to the supporting rod 24. In this case, the assembly of the treadmill of this disclosure may also be completed, and the number of the components is not limited to what is disclosed in this embodiment.

In summary, through the provision of the first and second through grooves 67, 68 in the bottom plates 63 of the side seats 6 so that the user can insert the left and right ends of the rear rotating shaft 21 of the running unit 2 upwardly into the first slide grooves 64 through the first through grooves 67 and insert the left and right ends of the front rotating shaft 22 of the running unit 2 upwardly into the second slide grooves 65 through the second through grooves 68, and by virtue of the assembly modules 3 assisting the user in moving the running unit 2 to the final installed position, the treadmill of the treadmill system of this disclosure can be assembled with little manpower. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A treadmill comprising:

a frame unit including a base frame and a top frame disposed on said base frame, said base frame including two spaced-apart side seats extending in a front-rear direction, and a plurality of connecting rods interconnecting said side seats, each of said side seats including a main plate, a top plate and a bottom plate respectively connected to and extending outwardly from top and bottom ends of said main plate in a left-right direction, a first slide groove formed in a rear end portion of said main plate, a second slide groove formed in a front end portion of said main plate, a first through groove formed in said bottom plate and communicating with said first slide groove, and a second through groove formed in said bottom plate and communicating with said second slide groove, said first slide groove having a vertical groove section extending in an up-down direction, and a horizontal groove section extending rearwardly from a top end of said vertical groove section, a bottom end of said vertical groove section communicating with said first through groove, said second slide groove extending in the up-down direction and having a bottom end communicating with said second through groove; and a running unit disposed between said side seats and including a rear rotating shaft having two opposite ends respectively inserted into said first slide grooves in said side seats, a front rotating shaft having two opposite ends respectively inserted into said second slide grooves in said side seats, and a running belt surrounding said front rotating shaft and said rear rotating shaft, said two opposite ends of said rear rotating shaft being inserted upwardly and respectively into said vertical groove sections of said first slide grooves through said first through grooves in said side seats, being respectively movable forward and rearward along said horizontal groove sections of said first slide grooves and being positioned in said horizontal groove sections, said two opposite ends of said front rotating shaft being inserted upwardly and respectively into said second slide grooves through said second through grooves in said side seats, and being respectively positioned on top ends of said second slide grooves.

2. The treadmill as claimed in claim 1, wherein each of said side seats further includes at least one third slide groove that is formed in said main plate, that is located between said first slide groove and said second slide groove, and that extends in the up-down direction, said running unit further including at least one supporting rod connected to and disposed between said side seats and located between said front rotating shaft and said rear rotating shaft, said at least one supporting rod being surrounded by said running belt, being configured to support said running belt, and corresponding in position to said third slide grooves in said side seats, said at least one supporting rod including a horizontal rod portion extending in the left-right direction, and two positioning plates respectively disposed on left and right ends of said horizontal rod portion, each of said positioning plates abutting against an inner side of said main plate of a respective one of said side seats, and having a positioning hole communicating with said third slide groove in said respective one of said side seats.

3. The treadmill as claimed in claim 1, wherein each of said side seats further includes a tensioning module disposed on said rear end portion of said main plate and adjacent to said first slide groove, said tensioning module including a fixed member disposed on said main plate, and a horizontal threaded rod movably inserted through said fixed member in the front-rear direction, said horizontal threaded rods of said tensioning modules of said side seats engaging threadedly and respectively said two opposite ends of said rear rotating shaft in the front-right direction for driving said two opposite ends of said rear rotating shaft to move forward and rearward in said horizontal groove sections of said first slide grooves.

4. A treadmill system, comprising:

said treadmill as claimed in claim 1; and at least two pairs of assembly modules for mounting said running unit to said base frame, each of said assembly modules including a vertical threaded rod extending through said top plate of a corresponding one of said side seats in the up-down direction, and a ring frame for insertion of said vertical threaded rod threadedly therethrough, said vertical threaded rod being rotated to allow said ring frame to move up and down along said vertical threaded rod, one pair of said at least two pairs of assembly modules being mounted on said rear rotating shaft, said ring frames of said one pair of said at least two pairs of assembly modules being respectively sleeved on said two opposite ends of said rear rotating shaft, another pair of said at least two pairs of assembly modules being mounted on said front rotating shaft, said ring frames of said another pair of said at least two pairs of assembly modules being respectively sleeved on said two opposite ends of said front rotating shaft;

said at least two pairs of assembly modules being capable of driving said running unit to move relative to said base frame from an initial installation position to a final installed position, wherein, when said running unit is in said initial installation position, said two opposite ends of said rear rotating shaft are respectively located at said bottom ends of said vertical groove sections of said first slide grooves, and said two opposite ends of said front rotating shaft are respectively located at said bottom ends of said second slide grooves; and wherein, when said running unit is in said final installed position, said two opposite ends of said rear rotating shaft are respectively located at said top ends of said vertical groove sections, and said two opposite ends of said front rotating shaft are respectively located at said top ends of said second slide grooves.

5. The treadmill system as claimed in claim 4, wherein:

each of said side seats further includes at least one third slide groove that is formed in said main plate, that is located between said first slide groove and said second slide groove and that extends in the up-down direction;

said running unit further includes at least one supporting rod connected to said side seats and located between said front rotating shaft and said rear rotating shaft, said at least one supporting rod being surrounded by said running belt, being used to support said running belt, and corresponding in position to said third slide grooves in said side seats, said at least one supporting rod including a horizontal rod portion extending in the left-right direction, and two positioning plates respectively disposed on left and right ends of said horizontal rod portion, each of said positioning plates abutting against an inner side of said main plate of a respective of said side seats, and having an inner peripheral surface that defines a positioning hole communicating with said at least one third slide groove in said respective one of said side seats;

said at least two pairs of assembly modules includes three pairs of assembly modules, said ring frame of each of said assembly modules including a surrounding wall, and an insert piece protruding outwardly from said surrounding wall in the left-right direction, a first pair of said assembly modules being mounted on said rear rotating shaft, a second pair of said assembly modules being mounted on said front rotating shaft, a third pair of said assembly modules being mounted on said at least one supporting rod, said insert pieces of said ring frames of said third pair of said assembly modules being respectively inserted into said positioning holes of said positioning plates and respectively abutting against top ends of said inner peripheral surfaces of said positioning plates; and when said running unit is in said initial installation position, said positioning hole in each of said positioning plates corresponds in position to a bottom end of said at least one third slide groove; and when said running unit is in said final installed position, said positioning hole in each of said positioning plates corresponds in position to a top end of said at least one third slide groove.

6. The treadmill system as claimed in claim 4, wherein:

when said running unit is moved to said final installed position, said assembly modules are removed from said rear rotating shaft and said at least one supporting rod;

each of said side seats further includes a tensioning module disposed on said rear end portion of said main plate and adjacent to said first slide groove, said tensioning module including a fixed member disposed on said main plate, and a horizontal threaded rod movably through said fixed member the front-rear direction; and when said running unit is in said final installed position, said horizontal threaded rods of said tensioning modules of said side seats are engaged threadedly and respectively to said two opposite ends of said rear rotating shaft for driving said two opposite ends of said rear rotating shaft to move forward and rearward in said horizontal groove sections of said first slide grooves.

7. An assembly method of a treadmill of a treadmill system as claimed in claim 4, each of the side seats further including a tensioning module, the tensioning module including a fixed member and a horizontal threaded rod, the at least two pairs of assembly modules including three pairs of assembly modules, the assembly method comprising the steps of:

(A) placing the running unit on a ground surface, and then moving the base frame of the frame unit such that the side seats of the base frame are respectively located at two opposite sides of the running unit, the first through grooves in the side seats are respectively aligned with top sides of the two opposite ends of the rear rotating shaft, and the second through grooves in the side seats are respectively aligned with top sides of the two opposite ends of the front rotating shaft;

(B) lifting a rear end of the running unit so as to pass the two opposite ends of the rear rotating shaft upwardly and respectively through the first through grooves, followed by sleeving the ring frames of a first pair of the assembly modules respectively onto the two opposite ends of the rear rotating shaft, and inserting the vertical threaded rods of the first pair of the assembly modules threadedly and respectively into the ring frames in the up-down direction so as to respectively position the two opposite ends of the rear rotating shaft at bottom ends of the first slide grooves in the side seats;

(C) lifting a front end of the running unit so as to pass the two opposite ends of the front rotating shaft upwardly and respectively through the second through grooves, followed by sleeving the ring frames of a second pair of the assembly modules respectively onto the two opposite ends of the front rotating shaft, and inserting the vertical threaded rods of the second pair of the assembly modules threadedly and respectively into the ring frames of the second pair of the assembly modules in the up-down direction so as to respectively position the two opposite ends of the front rotating shaft at bottom ends of the second slide grooves in the side seats;

(D) rotating the vertical threaded rods of the first pair of the assembly modules so as to drive the ring frames of the first pair of the assembly modules together with the two opposite ends of the rear rotating shaft to move upwardly and respectively along the vertical groove sections of the first slide grooves to top ends of the first slide grooves, and rotating the vertical threaded rods of the second pair of the assembly modules so as to drive the ring frames of the second pair of the assembly modules together with the two opposite ends of the front rotating shaft to move upwardly and respectively along the second slide grooves to top ends of the second slide grooves;

(E) inserting the horizontal threaded rods of the tensioning modules of the side seats threadedly and respectively into the two opposite ends of the rear rotating shaft in the front-rear direction, and removing the first pair of the assembly modules assembled to the two opposite ends of the rear rotating shaft, after which the horizontal threaded rods are rotated to move the two opposite ends of the rear rotating shaft rearwardly and respectively to rear ends of the horizontal groove sections of the first slide grooves; and (F) mounting the top frame of the frame unit to a front end of the base frame.

8. The assembly method as claimed in claim 7, wherein:

the running unit further includes at least one supporting rod connected to and disposed between the side seats and located between the front rotating shaft and the rear rotating shaft, the at least one supporting rod including a horizontal rod portion and two positioning plates respectively disposed on left and right ends of the horizontal rod portion, each of the positioning plates having an inner peripheral surface that defines a positioning hole;

each of the side seats further includes at least one third slide groove formed in the main plate, located between the first slide groove and the second slide groove, extending in the up-down direction, and communicating with the positioning hole in a respective one of the positioning plates;

step (C) further includes step (C-1), in which the insert pieces of the ring frames of a third pair of the assembly modules are respectively passed through the third slide grooves in the side seats, and are respectively inserted into the positioning holes in the positioning plates of the at least one supporting rod such that the insert pieces of the ring frames of the third pair of the assembly modules respectively abut against top ends of the inner peripheral surfaces of the positioning plates so as to position the at least one supporting rod at bottom ends of the third slide grooves; and step (D) further includes step (D-1), in which the vertical threaded rods of the third pair of the assembly modules are rotated so as to drive the insert pieces of the ring frames of the third pair of the assembly module together with the at least one supporting rod to move upwardly and respectively along the third slide grooves in the side seats to a position corresponding to top ends of the third slide grooves.

* * * * *